United States Patent [19]

O'Neill

[11] 4,392,258

[45] Jul. 12, 1983

[54] SHADE SHIRT

[76] Inventor: Michael H. O'Neill, 1071 41st Ave., Santa Cruz, Calif. 95062

[21] Appl. No.: 435,908

[22] Filed: Dec. 16, 1982

[51] Int. Cl.[3] ..... A42B 1/06; A41B 1/00

[52] U.S. Cl. ..... 2/209.1; 2/115

[58] Field of Search ..... 2/209.1, 115, 60, 209, 2/85, 171

[56] References Cited

U.S. PATENT DOCUMENTS

| | | | |
|---|---|---|---|
| 3,376,581 | 4/1968 | Gettinger | 2/209.1 |
| 4,080,665 | 3/1978 | Hodes | 2/209.1 |

*Primary Examiner*—Doris L. Troutman

*Attorney, Agent, or Firm*—Robert G. Slick

[57] ABSTRACT

An article of clothing in the nature of a T-shirt having a semi-stiff bill at the rear of the neck opening. The clothing can be worn as an ordinary shirt with the bill depending from the back of the neck opening or it can be worn over the head with the bill in front serving as an eyeshade.

1 Claim, 5 Drawing Figures

SHADE SHIRT

SUMMARY OF THE INVENTION

The present invention relates to an article of sports clothing which is in the nature of a T-shirt or sweater having a bill at the rear of the neck opening. Thus, the garment is one of great adaptability in that it can be worn as a shirt when the weather is cool and, then when the sun comes out, it may be taken off and placed over the head of the wearer with the bill serving as an eyeshade.

DESCRIPTION OF THE PREFERRED EMBODIMENTS

Figure 1:
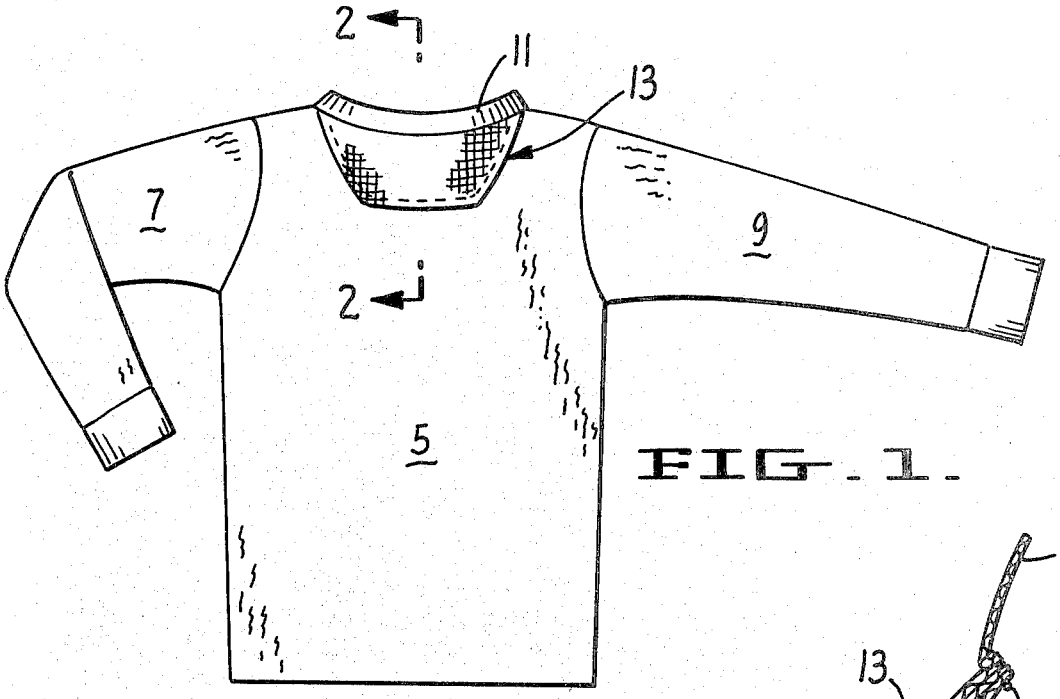
FIG. 1 is a rear view of a shirt embodying the present invention.
Figure 2:
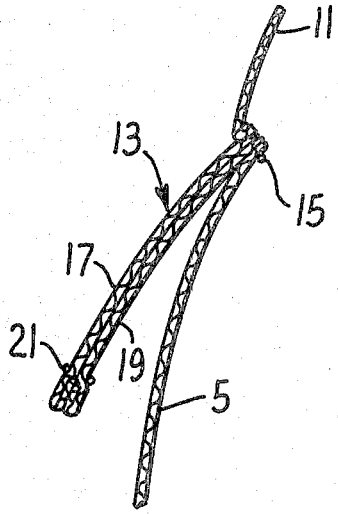
FIG. 2 is an enlarged section on the line 2—2 of FIG. 1.

The article of clothing of the present invention consists of a body 5 having arms 7 and 9. The clothing can be made of any desired fabric but in the preferred embodiment of the invention is a loose woven cotton material such as is ordinarily used for T-shirts or lightweight sweaters. The shirt has a conventional neck opening defined by a collar band 11. At the rear of the band, a bill generally designated 13 is attached, normally by sewing 15. The bill 13 is relatively stiff, yet pliable, and can be fabricated by two layers 17 and 19 of a relatively stiff fabric such as canvas sewen together at the terminal edge as at 21.

Figure 3:
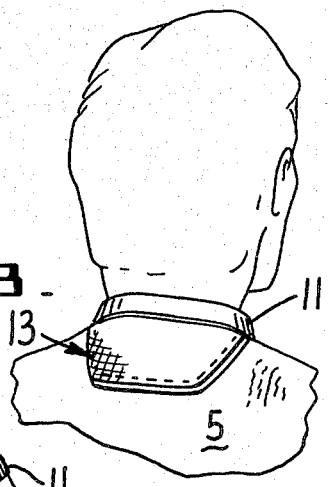
FIG. 3 is a perspective view of the upper portion of a person's body showing the article of clothing worn as a shirt.

In FIG. 3 there is illustrated how the article of clothing can be worn as a conventional shirt with the bill 13 hanging down the rear. The bill is relatively soft. It does not interfere with the comfort of the wearer.

Figure 4:
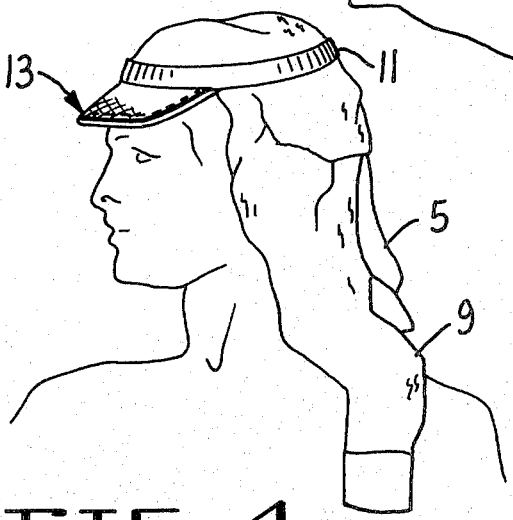
FIG. 4 is a front perspective view of one manner of wearing the shirt as a shade.

FIG. 4 shows one method of wearing the article of clothing as a head covering. It is merely placed over the head, the bill 13 in front, shading the eyes. The sleeves may be allowed to dangle as is shown at 9.

Figure 5:
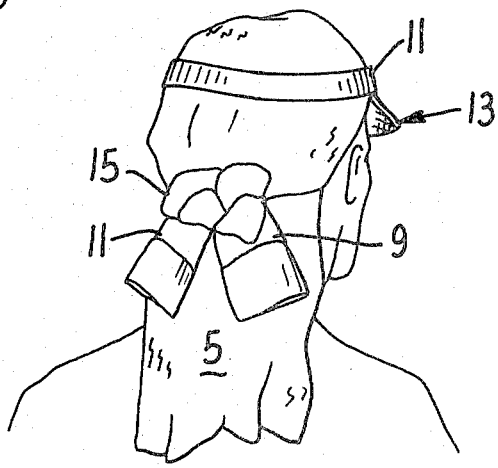
FIG. 5 is another perspective view showing a different manner of wearing the shirt as a shade.

FIG. 5 illustrates another method of wearing the shirt as a sunshade and here the sleeves 9 and 11 have been tied in a knot 15 with only a small portion of the body 5 hanging down the back of the wearer.

Many variations can be made in the exact structure shown. The shirt has been illustrated as having long sleeves, yet it can effectively be made in a short sleeved or sleeveless model. Also, the usual T-shirt has an oval neck opening but many different front openings can be used such as a scooped neck or a V neck.

I claim:

1. A convertible article of clothing having a fabric covering the upper torso in the manner of a T-shirt or sweater and having a neck opening defining a rear margin and a semistiff bill attached to said rear margin of the neck opening whereby said article of clothing can be worn as a shirt with the bill depending from the back of the garment or placed over the head with the bill in front serving as an eyeshade.

* * * * *